US009397771B2

(12) United States Patent
Jax et al.

(10) Patent No.: US 9,397,771 B2
(45) Date of Patent: Jul. 19, 2016

(54) METHOD AND APPARATUS FOR ENCODING AND DECODING SUCCESSIVE FRAMES OF AN AMBISONICS REPRESENTATION OF A 2- OR 3-DIMENSIONAL SOUND FIELD

(75) Inventors: Peter Jax, Hannover (DE); Johann-Markus Batke, Hannover (DE); Johannes Boehm, Goettingen (DE); Sven Kordon, Wunstorf (DE)

(73) Assignee: DOLBY LABORATORIES LICENSING CORPORATION, San Francisco, CA (US)

( * ) Notice: Subject to any disclaimer, the term of this patent is extended or adjusted under 35 U.S.C. 154(b) by 729 days.

(21) Appl. No.: 13/333,461

(22) Filed: Dec. 21, 2011

(65) Prior Publication Data

US 2012/0155653 A1 Jun. 21, 2012

(30) Foreign Application Priority Data

Dec. 21, 2010 (EP) ..... 10306472

(51) Int. Cl.

*H04R 5/00* (2006.01)
*H04H 20/89* (2008.01)
*G10L 19/008* (2013.01)

(52) U.S. Cl.

CPC ..... *H04H 20/89* (2013.01); *G10L 19/008* (2013.01)

(58) Field of Classification Search

CPC ..... H04R 5/00; H04R 5/02; H04R 5/04; H04R 3/00; H04R 29/00; H04S 7/302; H04S 2420/11; H04S 3/002; H04S 2400/11; H04S 7/307; H04S 1/002; H04S 3/006; H04S 3/00; H04S 7/305; H04H 20/89; G01S 3/8006; G01S 3/801; G10L 19/008; G10L 19/173; H03G 3/00

USPC ..... 381/1, 20, 21, 22, 23, 23.1, 61, 73.1, 381/81, 89, 332, 119, 302, 303, 307, 310, 381/86, 91, 92, 122, 112, 113, 114, 115; 700/94; 704/500, 501

See application file for complete search history.

(56) References Cited

U.S. PATENT DOCUMENTS 6,678,647 B1 1/2004 Edler
2007/0269063 A1 * 11/2007 Goodwin et al. ..... 381/310

(Continued)

FOREIGN PATENT DOCUMENTS

CN 101647059 10/2010
EP WO02093556 11/2002

(Continued)

OTHER PUBLICATIONS

Laborie et al ("A New Comprehensive Approach of Surround Sound Recording", 114th Convention, Amsterdam, The Netherlands, Mar. 22-25, 2003, p. 1-20.*

(Continued)

*Primary Examiner* — Leshui Zhang
(74) *Attorney, Agent, or Firm* — Tutunjian & Bitetto, P.C.

(57) ABSTRACT

Representations of spatial audio scenes using higher-order Ambisonics HOA technology typically require a large number of coefficients per time instant. This data rate is too high for most practical applications that require real-time transmission of audio signals. According to the invention, the compression is carried out in spatial domain instead of HOA domain. The $(N+1)^2$ input HOA coefficients are transformed into $(N+1)^2$ equivalent signals in spatial domain, and the resulting $(N+1)^2$ time-domain signals are input to a bank of parallel perceptual codecs. At decoder side, the individual spatial-domain signals are decoded, and the spatial-domain coefficients are transformed back into HOA domain in order to recover the original HOA representation.

18 Claims, 6 Drawing Sheets

(56) References Cited

U.S. PATENT DOCUMENTS

| | | | | |
|---|---|---|---|---|
| 2008/0046253 | A1* | 2/2008 | Vinton et al. | 704/503 |
| 2009/0248425 | A1 | 10/2009 | Vetterli et al. | |
| 2010/0121634 | A1 | 5/2010 | Muesch | |

FOREIGN PATENT DOCUMENTS

| | | | |
|---|---|---|---|
| EP | 2205007 | A1 | 7/2010 |
| WO | WO0193556 | | 11/2002 |
| WO | WO2006052188 | | 5/2006 |

OTHER PUBLICATIONS

Daniel, et al, "Further Study of Sound Field Coding with Higher Order Ambisonics", 116th Convetion, Berlin, Germany, May 8-11, 2004, p. 1-14.*

European Search Report dated Jul. 1, 2011.

Cheng et al, "A spatial Squeezing Approach to Ambisonic Audio Compression", IEEE International Conference on Acoustics, Speech and Signal Processing 2008, Las Vegas, Nevada, USA, Mar. 30, 2008, pp. 369-372.

Goodwin et al, "Primary-Ambient Signal Decomposition and Vector-Based Localization for Spatial Audio Coding and Enhancement", IEEE International Convention on Acoustics, Speech & Signal Processing 2007, Honolulu, Hawaii, USA, Apr. 15, 2007, pp. 9-12.

Cheng et al, "Principles and Analysis of the Squeezing Approach to Low Bit Rate Spatial Audio Coding", IEEE International Convention on Acoustics, Speech & Signal Processing 2007, Honolulu, Hawaii, USA, Apr. 15, 2007, pp. 13-16.

Hellerud et al, "Spatial Redundancy in Higher Order Ambisonics and its use for Low Delay Lossless Compression", IEEE International Conference on Acoustics, Speech and Signal Processing 2009, Taipei, Taiwan, Apr. 19, 2009, pp. 269-272.

Pinto et al, "Wave Field Coding in the Spacetime Frequency Domain", IEEE International Conference on Acoustics, Speech and Signal Processing 2008, Las Vegas, Nevada, USA, Mar. 30, 2008, pp. 365-368.

Cheng et al, "Audio Coding by Squeezing: Analysis and Application to Compressing Multiple Soundfields", 17th European Signal Processing Conference, Glasgow, Scotland, UK, Aug. 24, 2009, pp. 909-913.

Goodwin et al., "A Frequency-Domain Framework for Spatial Audio Coding Based on Universal Spatial Cues", Proceedings of 120th Audio Engineering Society Convention, Paper 6751, Paris, France, May 2006, pp. 1-12.

Goodwin et al., "Analysis and Synthesis for Universal Spatial Audio Coding", Proceeding of 121st Audio Engineering Society Convention, Paper 6874, San Francisco, California, USA, Oct. 5, 2006, pp. 1-11.

Daniel, J., "Représentation de champs acoustiques, application à la transmission et à la reproduction de scènes sonores complexes dans un contexte multimédia", Ph.D. thesis, Université de Paris 6, Jul. 31, 2001, pp. 1-319. English Abstract.

Malham, D., "Higher Order Ambisonic Systems", Abstracted from "Space in Music—Music in Space", Master's thesis by Dave Malham, University of York, Apr. 1, 2003, pp. 1-12.

Pulkki, V., "Virtual Sound Source Positioning Using Vector Base Amplitude Panning", Journal of the Audio Engineering Society, vol. 45, No. 6, Jun. 1997, pp. 456-466.

Pulkki, V., "Spatial Sound Reproduction with Directional Audio Coding", Journal of the Audio Engineering Society, vol. 55, No. 6, Jun. 2007, pp. 503-516.

Hellerud et al, "Encoding Higher Order Ambisonics with AAC", Proceedings of 124th Audio Engineering Society Convention, Paper 7366, Amsterdam, The Netherlands, May 17, 2008, pp. 501-508.

Solvang et al., "Quantization of 2D Higher Order Ambisonics Wave Fields", Proceedings of 124th Audio Engineering Society Convention, Paper 7370, Amsterdam, The Netherlands, May 17, 2008, pp. 1-9.

Chapman et al., "A Standard for Interchange of Ambisonic Signal Sets", Proceedings of 1st Ambisonics Symposium, Graz, Austria, Jun. 25, 2009. pp. 1-6.

Pomberger et al., "An Ambisonics Format for Flexible Playback Layouts", Proceedings of 1st Ambisonics Symposium, Graz, Austria, Jun. 25, 2009, pp. 1-8.

Horbach et al., "Real-Time rendering of Dynamic Scenes Using Wave Field Synthesis", Proceedings of IEEE International Conference on Multimedia and Expo (ICME), Lausanne, Switzerland, Aug. 1, 2002, pp. 517-520.

Pulkki et al., "Multichannel Audio Rendering Using Amplitude Panning", IEEE Signal Processing Magazine, May 2008, pp. 118-122.

Pulkki et al "Spatial Impulse Response Rendering: A Tool for Reproducing Room Acoustics for Multi-channel Listening", Journal of the Audio Engineering Society, vol. 53, No. 12, Dec. 2005, pp. 1-8.

Pinto et al., "Space-Time-Frequency Processing of Acoustic Wave Fields: Theory, Algorithms, and Applications", IEEE Transactions on Signal Processing, vol. 58, No. 9, Sep. 2010, pp. 4608-4620.

Pinto et al., "Coding of Spatio-Temporal Audio Spectra Using Tree-Structured Directional Filterbanks", IEEE Workshop on Applications of Signal Processing to Audio and Acoustics (WASPAA), New Paltz, New York, USA, Oct. 18, 2009, pp. 277-280.

Kahrs et al., "Applications of Digital Signal Processing to Audio and Acoustics", Kluwer Academic Publishers, New York, Jan. 1, 2002, pp. 1-571.

Fliege et al., "The Distribution of Points on the Sphere and Corresponding Cubature Formulae", IMA Journal of Numerical Analysis, vol. 19, No. 2, Jan. 1999, pp. 317-334.

Pulkki et al., "Directional Audio Coding: Filterbank and STFT-based Design", Proceedings of 120th Audio Engineering Society Convention, Paper 6658, Paris, France, May 20, 2006, pp. 1-12.

Pulkki et al., "Reproduction of Reverberation with Spatial Impulse Response Rendering", Proceedings of the 116th Audio Engineering Society Convention, Paper 6057, Berlin, Germany, May 8, 2004, pp. 1-13.

Pinto et al., "Bitstream Format for Spatio-Temporal Wave Field Coder", Proceedings of 124th Audio Engineering Society Convention, Paper 7472, Amsterdam, The Netherlands, May 17, 2008, pp. 1-15.

Blauert, J., "Spatial Hearing: The Psychophysics of Human Sound Localization", The MIT Press, Boston, Oct. 1996, pp. 1. Abstract.

* cited by examiner

METHOD AND APPARATUS FOR ENCODING AND DECODING SUCCESSIVE FRAMES OF AN AMBISONICS REPRESENTATION OF A 2- OR 3-DIMENSIONAL SOUND FIELD

This application claims the benefit, under 35 U.S.C. §119 of EP Patent Application 10306472.1, filed 21 Dec. 2010.

FIELD OF THE INVENTION

The invention relates to a method and to an apparatus for encoding and decoding successive frames of a higher-order Ambisonics representation of a 2- or 3-dimensional sound field.

BACKGROUND OF THE INVENTION

Ambisonics uses specific coefficients based on spherical harmonics for providing a sound field description that in general is independent from any specific loudspeaker or microphone set-up. This leads to a description which does not require information about loudspeaker positions during sound field recording or generation of synthetic scenes. The reproduction accuracy in an Ambisonics system can be modified by its order N. By that order the number of required audio information channels for describing the sound field can be determined for a 3D system because this depends on the number of spherical harmonic bases. The number O of coefficients or channels is $O=(N+1)^2$.

Representations of complex spatial audio scenes using higher-order Ambisonics (HOA) technology (i.e. an order of 2 or higher) typically require a large number of coefficients per time instant. Each coefficient should have a considerable resolution, typically 24 bit/coefficient or more. Accordingly, the data rate required for transmitting an audio scene in raw HOA format is high. As an example, a 3rd order HOA signal, e.g. recorded with an EigenMike recording system, requires a bandwidth of $(3+1)^2$ coefficients*44100 Hz 24 bit/coefficient=16.15 Mbit/s. As of today, this data rate is too high for most practical applications that require real-time transmission of audio signals. Hence, compression techniques are desired for practically relevant HOA-related audio processing systems.

Higher-order Ambisonics is a mathematical paradigm that allows capturing, manipulating and storage of audio scenes. The sound field is approximated at and around a reference point in space by a Fourier-Bessel series. Because HOA coefficients have this specific underlying mathematics, specific compression techniques have to be applied in order to obtain optimal coding efficiencies. Aspects of both, redundancy and psycho-acoustics, are to be accounted for, and can be expected to function differently for a complex spatial audio scene than for conventional mono or multi-channel signals. A particular difference to established audio formats is that all 'channels' in a HOA representation are computed with the same reference location in space. Hence, considerable coherence between HOA coefficients can be expected, at least for audio scenes with few, dominant sound objects.

There exist only few published techniques for lossy compression of HOA signals. Most of them can not be accounted to the category of perceptual coding because typically no psycho-acoustic model is utilized for controlling the compression. In contrast, several existing schemes use a decomposition of the audio scene into parameters of an underlying model.

Early Approaches for 1st to 3rd-Order Ambisonics Transmission

The theory of Ambisonics has been in use for audio production and consumption since the 1960's, although up to now the applications were mostly limited to 1st or 2nd order content. A number of distribution formats have been in use, in particular:

- B-format: This format is the standard professional, raw signal format used for exchange of content among researchers, producers and enthusiasts. Typically, it relates to 1st order Ambisonics with specific normalization of the coefficients, but there also exist specifications up to order 3.
- In recent higher-order variants of the B-format, modified normalization schemes like SN3D, and special weighting rules, e.g. the Furse-Malham aka FuMa or FMH set, typically result in a downscaling of the amplitudes of parts of the Ambisonics coefficient data. The reverse upscaling operation is performed by table lookup before decoding at receiver side.
- UHJ-format (aka C-format): This is a hierarchical encoded signal format that is applicable for delivering 1st order Ambisonics content to consumers via existing mono or two-channel stereo paths. With two channels, left and right, a full horizontal surround representation of an audio scene is feasible, albeit not with full spatial resolution. The optional third channel improves the spatial resolution in the horizontal plane, and the optional fourth channel adds the height dimension.
- G-format: This format was created in order to make content produced in Ambisonics format available to anyone, without the need to use specific Ambisonics decoders at home. Decoding to the standard 5-channel surround setup is performed already at production side. Because the decoding operation is not standardized, a reliable reconstruction of the original B-format Ambisonics content is not possible.
- D-format: This format refers to the set of decoded loudspeaker signals as produced by an arbitrary Ambisonics decoder. The decoded signals depend on the specific loudspeaker geometry and on specifics of the decoder design. The G-format is a subset of the D-format definition, because it refers to a specific 5-channel surround setup.

Neither one of the aforementioned approaches has been designed with compression in mind. Some of the formats have been tailored in order to make use of existing, low-capacity transmission paths (e.g. stereo links) and therefore implicitly reduce the data rate for transmission. However, the downmixed signal lacks a significant portion of original input signal information. Thus, the flexibility and universality of the Ambisonics approach is lost.

Directional Audio Coding

Around 2005 the DirAC (directional audio coding) technology has been developed, which is based on a scene analysis with the target to decompose the scene into one dominant sound object per time and frequency plus ambient sound. The scene analysis is based on an evaluation of the instantaneous intensity vector of the sound field. The two parts of the scene will be transmitted together with location information on where the direct sound comes from. At the receiver, the single dominant sound source per time-frequency pane is played back using vector based amplitude panning (VBAP). In addition, de-correlated ambient sound is produced according to the ratio that has been transmitted as side information. The DirAC processing is depicted in FIG. 1, wherein the input signals have B-format.

One can interpret DirAC as a specific way of parametric coding with a single-source-plus-ambience signal model. The quality of the transmission depends strongly on whether the model assumptions are true for the particular compressed audio scene. Furthermore, any erroneous detection of direct sound and/or ambient sound in the sound analysis stage may impact the quality of the playback of the decoded audio scene. To date, DirAC has only been described for 1st order Ambisonics content.

Direct Compression of HOA Coefficients

In the late 2000s, a perceptual as well as lossless compression of HOA signals has been proposed.

For lossless coding, cross-correlation between different Ambisonics coefficients is exploited for reducing the redundancy of HOA signals, as described in E. Hellerud, A. Solvang, U. P. Svensson, "Spatial Redundancy in Higher Order Ambisonics and Its Use for Low Delay Lossless Compression", Proc. of IEEE Intl. Conf. on Acoustics, Speech, and Signal Processing (ICASSP), April 2009, Taipei, Taiwan, and in E. Hellerud, U. P. Svensson, "Lossless Compression of Spherical Microphone Array Recordings", Proc. of 126th AES Convention, Paper 7668, May 2009, Munich, Germany. Backward adaptive prediction is utilized which predicts current coefficients of a specific order from a weighted combination of preceding coefficients up to the order of the coefficient to be encoded. The groups of coefficients that are expected to exhibit strong cross-correlation have been found by evaluations of characteristics of real-world content.

This compression operates in a hierarchical manner. The neighborhood analyzed for potential cross-correlation of a coefficient comprises the coefficients only up to the same order at the same time instant as well as at preceding time instances, whereby the compression is scalable on bit stream level.

Perceptual coding is described in T. Hirvonen, J. Ahonen, V. Pulkki, "Perceptual Compression Methods for Metadata in Directional Audio Coding Applied to Audiovisual Teleconference", Proc. of 126$^{th}$ AES Convention, Paper 7706, May 2009, Munich, Germany, and in the above-mentioned "Spatial Redundancy in Higher Order Ambisonics and Its Use for Low Delay Lossless Compression" article. Existing MPEG AAC compression techniques are used for coding the individual channels (i.e. coefficients) of an HOA B-format representation. By adjusting the bit allocation depending on the order of the channel, a non-uniform spatial noise distribution has been obtained. In particular, by allocating more bits to the low-order channels and fewer bits to high-order channels, a superior precision can be obtained near the reference point. In turn, the effective quantization noise rises for increasing distances from the origin.

FIG. 2 shows the principle of such direct encoding and decoding of B-format audio signals, wherein the upper path shows the above Hellerud et al. compression and the lower path shows compression to conventional D-format signals. In both cases the decoded receiver output signals have D-format.

A problem with seeking for redundancy and irrelevancy directly in the HOA domain is that any spatial information is, in general, 'smeared' across several HOA coefficients. In other words, information that is well localized and concentrated in spatial domain is spread around. Thereby it is very challenging to perform a consistent noise allocation that reliably adheres to psycho-acoustic masking constraints. Furthermore, important information is captured in a differential fashion in the HOA domain, and subtle differences of large-scale coefficients may have a strong impact in the spatial domain. Therefore a high data rate may be required in order to preserve such differential details.

Spatial Squeezing

More recently, B. Cheng, Ch. Ritz, I. Burnett have developed the 'spatial squeezing' technology:

B. Cheng, Ch. Ritz, I. Burnett, "Spatial Audio Coding by Squeezing: Analysis and Application to Compressing Multiple Soundfields", Proc. of European Signal Processing Conf. (EUSIPCO), 2009, B. Cheng, Ch. Ritz, I. Burnett, "A Spatial Squeezing Approach to Ambisonic Audio Compression", Proc. of IEEE Intl. Conf. on Acoustics, Speech, and Signal Processing (ICASSP), April 2008, B. Cheng, Ch. Ritz, I. Burnett, "Principles and Analysis of the Squeezing Approach to Low Bit Rate Spatial Audio Coding", Proc. of IEEE Intl. Conf. on Acoustics, Speech, and Signal Processing (ICASSP), April 2007.

An audio scene analysis is carried out which decomposes the sound field into the selection of the most dominant sound objects for each time/frequency pane. Then a 2-channel stereo downmix is created which contains these dominant sound objects at new positions, in-between the positions of the left and right channels. Because the same analysis can be done with the stereo signal, the operation can be partially reversed by re-mapping the objects detected in the 2-channel stereo downmix to the 360° of the full sound field.

FIG. 3 depicts the principle of spatial squeezing. FIG. 4 shows the related encoding processing.

The concept is strongly related to DirAC because it relies on the same kind of audio scene analysis. However, in contrast to DirAC the downmix always creates two channels, and it is not necessary to transmit side information about the location of dominant sound objects.

Although psycho-acoustic principles are not explicitly utilized, the scheme exploits the assumption that a decent quality can already be achieved by only transmitting the most prominent sound object for time-frequency tiles. In that respect, there are further strong parallels to the assumptions of DirAC. Analog to DirAC, any error in the parameterization of the audio scene will result in an artifact of the decoded audio scene. Furthermore, the impact of any perceptual coding of the 2-channel stereo downmix signal to the quality of the decoded audio scene is hard to predict. Due to the generic architecture of this spatial squeezing it can not be applied for 3-dimensional audio signals (i.e. signals with height dimension), and apparently it does not work for Ambisonics orders beyond one.

Ambisonics Format and Mixed-Order Representations

It has been proposed in F. Zotter, H. Pomberger, M. Noisternig, "Ambisonic Decoding with and without Mode-Matching: A Case Study Using the Hemisphere", Proc. of 2nd Ambisonics Symposium, May 2010, Paris, France, to constrain the spatial sound information to a sub-space of the full sphere, e.g. to only cover the upper hemisphere or even smaller parts of the sphere. In the ultimate, a complete scene can be composed of several such constrained 'sectors' on the sphere which will be rotated to specific locations for assembling the target audio scene. This creates a kind of mixed-order composition of a complex audio scene. No perceptual coding is mentioned.

Parametric Coding

The 'classic' approach for describing and transmitting content intended to be played back in wave-field synthesis (WFS) systems is via parametric coding of individual sound objects of the audio scene. Each sound object consists of an audio stream (mono, stereo or something else) plus meta information on the role of the sound object within the full audio scene, i.e. most importantly the location of the object. This object-oriented paradigm has been refined for WFS playback in the course of the European 'CARROUSO', cf. S. Brix, Th. Sporer, J. Plogsties, "CARROUSO—An European Approach to 3D-Audio", Proc. of 110th AES Convention, Paper 5314, May 2001, Amsterdam, The Netherlands.

One example for compressing each sound object independent from others is the joint coding of multiple objects in a downmix scenario as described in Ch. Faller, "Parametric Joint-Coding of Audio Sources", Proc. of 120th AES Convention, Paper 6752, May 2006, Paris, France, in which simple psycho-acoustic cues are used in order to create a meaningful downmix signal from which, with the help of side information, the multi-object scene can be decoded at the receiver side. The rendering of the objects within the audio scene to the local loudspeaker setup also takes place at receiver side.

In object-oriented formats recording is particularly sophisticated. In theory, perfectly 'dry' recordings of the individual sound objects would be required, i.e. recordings that exclusively capture the direct sound emitted by a sound object. The challenge of this approach is two-fold: first, dry capturing is difficult in natural 'live' recordings because there is considerable crosstalk between microphone signals; second, audio scenes which are assembled from dry recordings lack naturalness and the 'atmosphere' of the room in which the recording took place.

Parametric Coding Plus Ambisonics

Some researchers have proposed to combine an Ambisonics signal with a number of discrete sound objects. The rationale is to capture ambient sound and sound objects that are not well localizable via the Ambisonics representation and to add a number of discrete, well-placed sound objects via a parametric approach. For the object-oriented part of the scene similar coding mechanisms are used as for purely parametric representations (see the previous section). That is, those individual sound objects typically come with a mono sound track and information on location and potential movements, cf. the introduction of Ambisonics playback to the MPEG-4 AudioBIFS standard. In that standard, how to transmit the raw Ambisonics and object streams to the (AudioBIFS) rendering engine is left open to the producer of an audio scene. This means that any audio codec defined in MPEG-4 can be used for directly encoding the Ambisonics coefficients.

Wave Field Coding

Instead of using the object-oriented approach, wave field coding transmits the already rendered loudspeaker signals of a WFS (wave field synthesis) system. The encoder carries out all the rendering to a specific set of loudspeakers. A multi-dimensional space-time to frequency transformation is performed for windowed, quasi-linear segments of the curved line of loudspeakers. The frequency coefficients (both for time-frequency and space-frequency) are encoded with some psycho-acoustic model. In addition to the usual time-frequency masking, also a space-frequency masking can be applied, i.e. it is assumed that masking phenomena are a function of spatial frequency. At decoder side the encoded loudspeaker channels are de-compressed and played back.

FIG. 5 shows the principle of Wave Field Coding with a set of microphones in the top part and a set of loudspeakers in the bottom part. FIG. 6 shows the encoding processing according to F. Pinto, M. Vetterli, "Wave Field Coding in the Spacetime Frequency Domain", Proc. of IEEE Intl. Conf. on Acoustics, Speech and Signal Processing (ICASSP), April 2008, Las Vegas, Nev., USA.

Published experiments on perceptual wave field coding show that the space-time-to-frequency transform saves about 15% of data rate compared to separate perceptual compression of the rendered loudspeaker channels for a two-source signal model. Nevertheless, this processing has not the compression efficiency to be obtained by an object-oriented paradigm, most probably due to the failure to capture sophisticated cross-correlation characteristics between loudspeaker channels because a sound wave will arrive at each loudspeaker at a different time. A further disadvantage is the tight coupling to the particular loudspeaker layout of the target system.

Universal Spatial Cues

The notion of a universal audio codec able to address different loudspeaker scenarios has also been considered, starting from classical multi-channel compression. In contrast to e.g. mp3 Surround or MPEG Surround with fixed channel assignments and relations, the representation of spatial cues is designed to be independent of the specific input loudspeaker configuration, cf. M. M. Goodwin, J.-M. Jot, "A Frequency-Domain Framework for Spatial Audio Coding Based on Universal Spatial Cues", Proc. of 120th AES Convention, Paper 6751, May 2006, Paris, France; M. M. Goodwin, J.-M. Jot, "Analysis and Synthesis for Universal Spatial Audio Coding", Proc. of 121st AES Convention, Paper 6874, October 2006, San Francisco, Calif., USA; M. M. Goodwin, J.-M. Jot, "Primary-Ambient Signal Decomposition and Vector-Based Localization for Spatial Audio Coding and Enhancement", Proc. of IEEE Intl. Conf. on Acoustics, Speech and Signal Processing (ICASSP), April 2007, Honolulu, Hi., USA.

Following frequency domain transformation of the discrete input channel signals, a principal component analysis is performed for each time-frequency tile in order to distinguish primary sound from ambient components. The result is the derivation of direction vectors to locations on a circle with unit radius centered at the listener, using Gerzon vectors for the scene analysis.

FIG. 7 depicts a corresponding system for spatial audio coding with downmixing and transmission of spatial cues. A (stereo) downmix signal is composed from the separated signal components and transmitted together with meta information on the object locations. The decoder recovers the primary sound and some ambient components from the downmix signals and the side information, whereby the primary sound is panned to local loudspeaker configuration. This can be interpreted as a multi-channel variant of the above DirAC processing because the transmitted information is very similar.

SUMMARY OF THE INVENTION

A problem to be solved by the invention is to provide improved lossy compression of HOA representations of audio scenes, whereby psycho-acoustic phenomena like perceptual masking are taken into account.

According to the invention, the compression is carried out in spatial domain instead of HOA domain (whereas in wave field encoding described above it is assumed that masking phenomena are a function of spatial frequency, the invention uses masking phenomena as a function of spatial location). The $(N+1)^2$ input HOA coefficients are transformed into $(N+1)^2$ equivalent signals in spatial domain, e.g. by plane wave decomposition. Each one of these equivalent signals represents the set of plane waves which come from associated directions in space. In a simplified way, the resulting signals can be interpreted as virtual beam forming microphone signals that capture from the input audio scene representation any plane waves that fall into the region of the associated beams.

The resulting set of $(N+1)^2$ signals are conventional time-domain signals which can be input to a bank of parallel perceptual codecs. Any existing perceptual compression technique can be applied. At decoder side, the individual spatial-domain signals are decoded, and the spatial-domain coefficients are transformed back into HOA domain in order to recover the original HOA representation.

This kind of processing has significant advantages:

Psycho-acoustic masking: If each spatial-domain signal is treated separately from the other spatial-domain signals, the coding error will have the same spatial distribution as the masker signal. Thus, after converting the decoded spatial-domain coefficients back to HOA domain, the spatial distribution of the instantaneous power density of the coding error will be positioned according to the spatial distribution of the power density of the original signal. Advantageously, thereby it is guaranteed that the coding error will always stay masked. Even in a sophisticated playback environment the coding error propagates always exactly together with the corresponding masker signal.

Note, however, that something analogous to 'stereo unmasking' (cf. M. Kahrs, K. H. Brandenburg, "Applications of Digital Signal Processing to Audio and Acoustics", Kluwer Academic Publishers, 1998) can still occur for sound objects that originally sit between two (2D case) or three (3D case) of the reference locations. However, probability and severity of this potential pitfall decrease if the order of the HOA input material increases, because the angular distance between different reference positions in the spatial domain decreases. By adapting the HOA-to-space transformation according to the location of dominant sound objects (see the specific embodiment below) this potential issue can be alleviated.

Spatial de-correlation: Audio scenes are typically sparse in spatial domain, and they are usually assumed to be a mixture of few discrete sound objects on top of an underlying ambient sound field. By transforming such audio scenes into HOA domain—which is essentially a transformation into spatial frequencies—the spatially sparse, i.e. de-correlated, scene representation is transformed into a highly correlated set of coefficients. Any information on a discrete sound object is 'smeared' across more or less all frequency coefficients.

In general, the aim in compression methods is to reduce redundancies by choosing a de-correlated coordinate system, ideally according to a Karhunen-Loève transformation. For time-domain audio signals, typically the frequency domain provides a more de-correlated signal representation. However, this is not the case for spatial audio because the spatial domain is closer to the KLT coordinate system than the HOA domain.

Concentration of temporally correlated signals: Another important aspect of transforming HOA coefficients into spatial domain is that signal components that are likely to exhibit strong temporal correlation—because they are emitted from the same physical sound source—are concentrated in single or few coefficients. This means that any subsequent processing step related to compressing the spatially distributed time-domain signals can exploit a maximum of time-domain correlation.

Comprehensibility: The coding and perceptual compression of audio content is well-known for time-domain signals.

In contrast, the redundancy and psycho-acoustics in a complex transformed domain like higher-order Ambisonics (i.e. an order of 2 or higher) is far less understood and requires a lot of mathematics and investigation. Consequently, when using compression techniques that work in spatial domain rather than HOA domain, many existing insights and techniques can be applied and adapted much easier. Advantageously, reasonable results can be obtained quickly by utilizing existing compression codecs for parts of the system.

In other words, the invention includes the following advantages:

better utilization of psycho-acoustic masking effects,
better comprehensibility and easy to implement,
better suited for the typical composition of spatial audio scenes,
better de-correlation properties than existing approaches.

In principle, the inventive encoding method is suited for encoding successive frames of an Ambisonics representation of a 2- or 3-dimensional sound field, denoted HOA coefficients, said method comprising the steps:

transforming $O=(N+1)^2$ input HOA coefficients of a frame into O spatial domain signals representing a regular distribution of reference points on a sphere, wherein N is the order of said HOA coefficients and each one of said spatial domain signals represents a set of plane waves which come from associated directions in space;

encoding each one of said spatial domain signals using perceptual encoding steps or stages, thereby using encoding parameters selected such that the coding error is inaudible;

multiplexing the resulting bit streams of a frame into a joint bit stream.

In principle, the inventive decoding method is suited for decoding successive frames of an encoded higher-order Ambisonics representation of a 2- or 3-dimensional sound field, which was encoded according to claim 1, said decoding method comprising the steps:

de-multiplexing the received joint bit stream into $O=(N+1)^2$ encoded spatial domain signals;

decoding each one of said encoded spatial domain signals into a corresponding decoded spatial domain signal using perceptual decoding steps or stages corresponding to the selected encoding type and using decoding parameters matching the encoding parameters, wherein said decoded spatial domain signals represent a regular distribution of reference points on a sphere;

transforming said decoded spatial domain signals into O output HOA coefficients of a frame, wherein N is the order of said HOA coefficients.

In principle the inventive encoding apparatus is suited for encoding successive frames of a higher-order Ambisonics representation of a 2- or 3-dimensional sound field, denoted HOA coefficients, said apparatus comprising:

transforming means being adapted for transforming $O=(N+1)^2$ input HOA coefficients of a frame into O spatial domain signals representing a regular distribution of reference points on a sphere, wherein N is the order of said HOA coefficients and each one of said spatial domain signals represents a set of plane waves which come from associated directions in space;

means being adapted for encoding each one of said spatial domain signals using perceptual encoding steps or stages, thereby using encoding parameters selected such that the coding error is inaudible;

means being adapted for multiplexing the resulting bit streams of a frame into a joint bit stream.

In principle the inventive encoding apparatus is suited for decoding successive frames of an encoded higher-order Ambisonics representation of a 2- or 3-dimensional sound field, which was encoded according to claim 1, said apparatus comprising:

means being adapted for de-multiplexing the received joint bit stream into $O=(N+1)^2$ encoded spatial domain signals;

means being adapted for decoding each one of said encoded spatial domain signals into a corresponding decoded spatial domain signal using perceptual decoding steps or stages corresponding to the selected encoding type and using decoding parameters matching the encoding parameters, wherein said decoded spatial domain signals represent a regular distribution of reference points on a sphere;

transforming means being adapted for transforming said decoded spatial domain signals into O output HOA coefficients of a frame, wherein N is the order of said HOA coefficients.

Advantageous additional embodiments of the invention are disclosed in the respective dependent claims.

BRIEF DESCRIPTION OF THE DRAWINGS

Exemplary embodiments of the invention are described with reference to the accompanying drawings, which show in.

DETAILED DESCRIPTION

Figure 1:
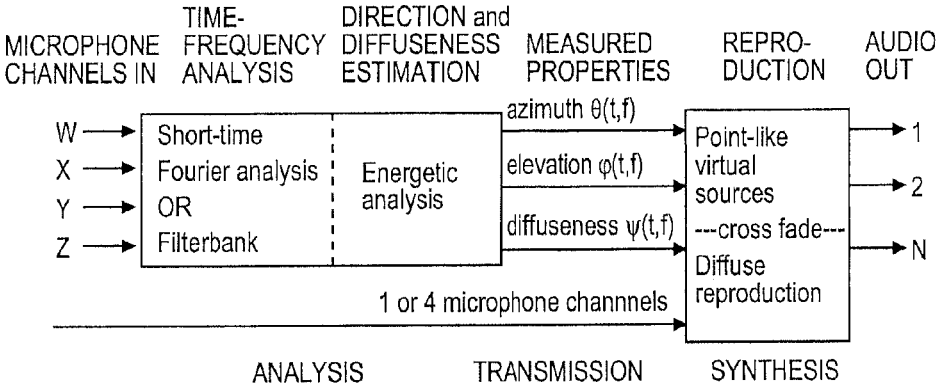
Fig. 1 (Prior Art)
FIG. 1 directional audio coding with B-format input.
Figure 2:
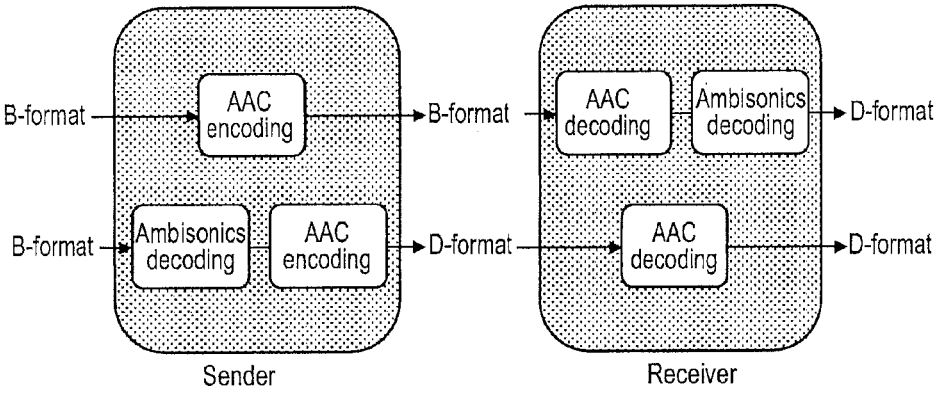
Fig. 2 (Prior Art)
FIG. 2 direct encoding of B-format signals.
Figure 3:
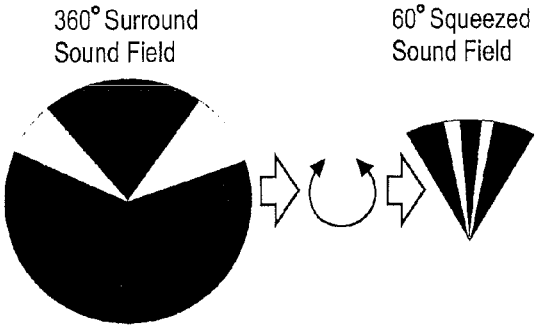
Fig. 3 (Prior Art)
FIG. 3 principle of spatial squeezing.
Figure 4:
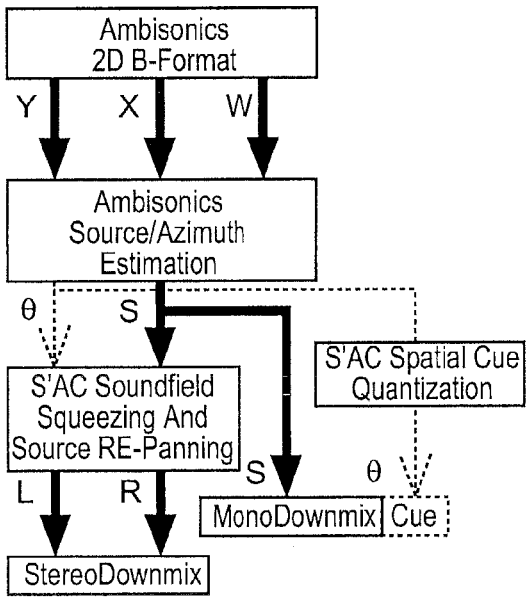
Fig. 4 (Prior Art)
FIG. 4 spatial squeezing encoding processing.
Figure 5:
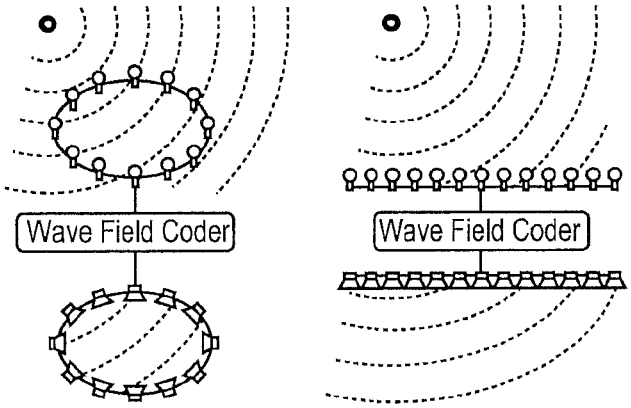
Fig. 5 (Prior Art)
FIG. 5 principle of Wave Field coding.
Figure 6:
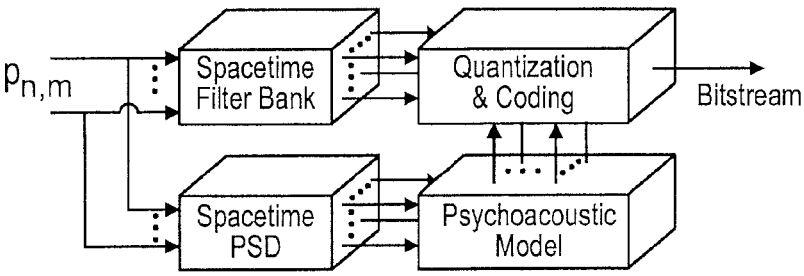
Fig. 6 (Prior Art)
FIG. 6 Wave Field encoding processing.
Figure 7:
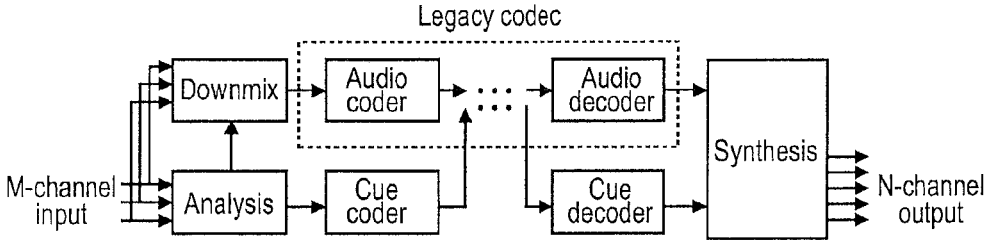
Fig. 7 (Prior Art)
FIG. 7 spatial audio coding with downmixing and transmission of spatial cues.
Figure 8:
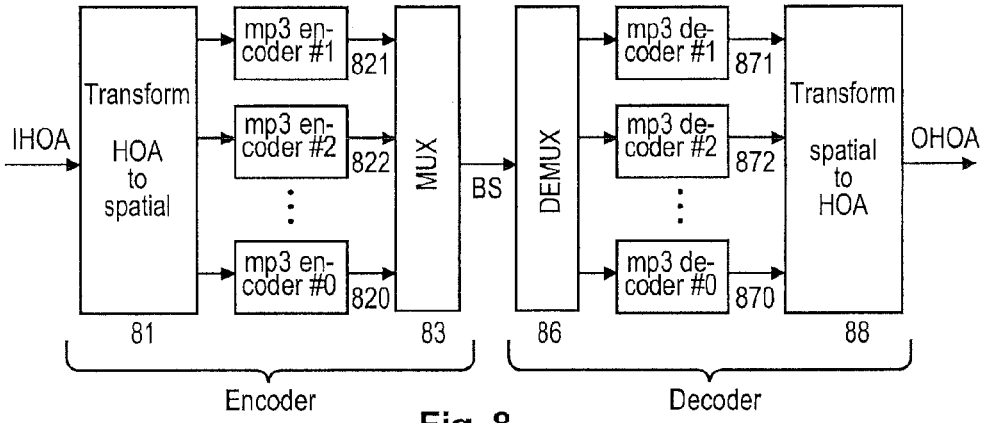
FIG. 8 exemplary embodiment of the inventive encoder and decoder.

FIG. 8 shows a block diagram of an inventive encoder and decoder. In this basic embodiment of the invention, successive frames of input HOA representations or signals IHOA are transformed in a transform step or stage 81 to spatial-domain signals according to a regular distribution of reference points on the 3-dimensional sphere or the 2-dimensional circle.

Regarding transformation from HOA domain to spatial domain, in Ambisonics theory the sound field at and around a specific point in space is described by a truncated Fourier-Bessel series. In general, the reference point is assumed to be at the origin of the chosen coordinate system. For a 3-dimensional application using spherical coordinates, the Fourier series with coefficients $A_n^m$ for all defined indices n=0, 1, . . . N and m=−n, . . . , n describes the pressure of the sound field at azimuth angle $\phi$, inclination $\theta$ and distance r from the origin $p(r, \theta, \phi)=\Sigma_{n=0}^{N}\Sigma_{m=-n}^{n} C_n^m j_n(kr) Y_n^m(\theta, \phi)$, wherein k is the wave number and $j_n(kr) Y_n^m(\phi, \theta)$ is the kernel function of the Fourier-Bessel series that is strictly related to the spherical harmonic for the direction defined by $\theta$ and $\phi$. For convenience, HOA coefficients $A_n^m$ are used with the definition $A_n^m=C_n^m j_n(kr)$. For a specific order N the number of coefficients in the Fourier-Bessel series is $O=(N+1)^2$.

For a 2-dimensional application using circular coordinates, the kernel functions depend only on the azimuth angle $\phi$. All coefficients with $m\neq n$ have a value of zero and can be omitted. Therefore the number of HOA coefficients is reduced to only O=2N+1. Moreover, the inclination $\theta=\pi/2$ is fixed.

For the 2D case and for a perfectly uniform distribution of the sound objects on the circle, i.e. with $$\phi_i = i\frac{2\pi}{o},$$

the mode vectors within $\Psi$ are identical to the kernel functions of the well-known discrete Fourier transform (DFT).

By the HOA-to-spatial-domain transformation the driver signal of virtual loudspeakers (emitting plane waves at infinite distance) are derived, that have to be applied in order to precisely playback the desired sound field as described by the input HOA coefficients.

All mode coefficients can be combined in a mode matrix W where the i-th column contains the mode vector $Y_n^m(\phi_i, \theta_i)$, n=0 . . . N, m=−n . . . n according to the direction of the i-th virtual loudspeaker. The number of desired signals in spatial domain is equal to the number of HOA coefficients. Hence, a unique solution to the transformation/decoding problem exists that is defined by the inverse $\Psi^{-1}$ of the mode matrix $\Psi$: $s=\Psi^{-1} A$. This transformation uses the assumption that the virtual loudspeakers emit plane waves. Real-world loudspeakers have different playback characteristics which a decoding rule for playback should take care of.

One example for reference points are the sampling points according to J. Fliege, U. Maier, "The Distribution of Points on the Sphere and Corresponding Cubature Formulae", IMA Journal of Numerical Analysis, vol. 19, no. 2, pp. 317-334, 1999. The spatial-domain signals obtained by this transformation are input to independent, 'O' parallel known perceptual encoder steps or stages 821, 822, . . . , 820 which operate e.g. according to the MPEG-1 Audio Layer III (aka mp3) standard, wherein 'O' corresponds to the number O of parallel channels. Each of these encoders is parameterized such that the coding error will be inaudible. The resulting parallel bit streams are multiplexed in a multiplexer step or stage 83 into a joint bit stream BS and transmitted to the decoder side. Instead of mp3, any other suitable audio codec type like AAC or Dolby AC-3 can be used.

At decoder side a de-multiplexer step or stage 86 demultiplexes the received joint bit stream in order to derive the individual bit streams of the parallel perceptual codecs, which individual bit streams are decoded (corresponding to the selected encoding type and using decoding parameters matching the encoding parameters, i.e. selected such that the decoding error is inaudible) in known decoder steps or stages 871, 872, . . . , 87O in order to recover the uncompressed spatial-domain signals. The resulting vectors of signals are transformed in an inverse transform step or stage 88 for each time instant into the HOA domain, thereby recovering the decoded HOA representation or signal OHOA, which is output in successive frames.

With such processing or system a considerable reduction in data rate can be obtained. For example, an input HOA representation from a 3rd order recording of an EigenMike has a raw data rate of $(3+1)^2$ coefficients*44100 Hz*24 bit/coefficient=16.9344 Mbit/s. Transformation into spatial domain results in $(3+1)^2$ signals with a sample rate of 44100 Hz. Each of these (mono) signals representing a data rate of 44100*24=1.0584 Mbit/s is independently compressed using an mp3 codec to an individual data rate of 64 kbit/s (which means virtually transparent for mono signals). Then, the gross data rate of the joint bit stream is $(3+1)^2$ signals*64 kbit/s per signal≈1 Mbit/s.

This assessment is on the conservative side because it assumes that the whole sphere around the listener is filled homogeneously with sound, and because it totally neglects any cross-masking effects between sound objects at different spatial locations: a masker signal with, say 80 dB, will mask a weak tone (say at 40 dB) that is only a few degrees of angle apart. By taking such spatial masking effects into account as described below, higher compression factors can be achieved. Furthermore, the above assessment neglects any correlation between adjacent positions in the set of spatial-domain signals. Again, if a better compression processing makes use of such correlation, higher compression ratios can be achieved. Last but not least, if time-varying bit rates are admissible, still more compression efficiency can be expected because the number of objects in a sound scene varies strongly, especially for film sound. Any sound object sparseness can be utilized to further reduce the resulting bit rate.

Variations: Psycho-Acoustics

In the embodiment of FIG. 8 a minimalistic bit rate control is assumed: all individual perceptual codecs are expected to run at identical data rates. As already mentioned above, considerable improvements can be obtained by using instead a more sophisticated bit rate control which takes the complete spatial audio scene into account. More specifically, the combination of time-frequency masking and spatial masking characteristics plays a key role. For the spatial dimension of this, masking phenomena are a function of absolute angular locations of sound events in relation to the listener, not of spatial frequency (note that this understanding is different from that in Pinto et al. mentioned in section Wave Field Coding). The difference between the masking threshold observed for spatial presentation compared to monodic presentation of masker and maskee is called the Binaural Masking Level Difference BMLD, cf. section 3.2.2 in J. Blauert, "Spatial Hearing: The Psychophysics of Human Sound Localization", The MIT Press, 1996. In general, the BMLD depends on several parameters like signal composition, spatial locations, frequency range. The masking threshold in spatial presentation can be up to ~20 dB lower than for monodic presentation. Therefore, utilization of masking threshold across spatial domain will take this into account.

A) One embodiment of the invention uses a psycho-acoustic masking model which yields a multi-dimensional masking threshold curve that depends on (time-)frequency as well as on angles of sound incidences on the full circle or sphere, respectively, depending on the dimension of the audio scene. This masking threshold can be obtained by combining the individual (time-)frequency masking curves obtained for the $(N+1)^2$ reference locations via manipulation with a spatial 'spreading function' that takes the BMLD into account. Thereby the influence of maskers to signals which are located nearby, i.e. which are positioned with a small angular distance to the masker, can be exploited.

Figure 9:
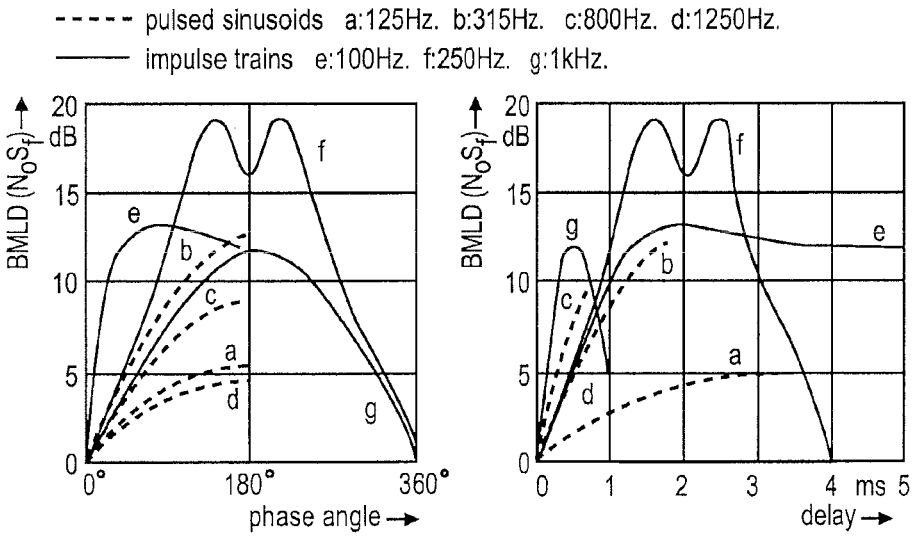
FIG. 9 binaural masking level difference for different signals as a function of the inter-aural phase difference or time difference of the signal.

FIG. 9 shows the BMLD for different signals (broadband noise masker plus sinusoids or 100 μs impulse trains as desired signal) as a function of the interaural phase difference or time difference (i.e. phase angles and time delays) of the signal, as disclosed in the above article "Spatial Hearing: The Psychophysics of Human Sound Localization".

The inverse of the worst-case characteristic (i.e. that with the highest BMLD values) can be used as conservative 'smearing' function for determining the influence of a masker in one direction to maskees in another direction. This worst-case requirement can be softened if BMLDs for specific cases are known. The most interesting cases are those where the masker is noise that is spatially narrow but wide in (time-)frequency.

Figure 10:
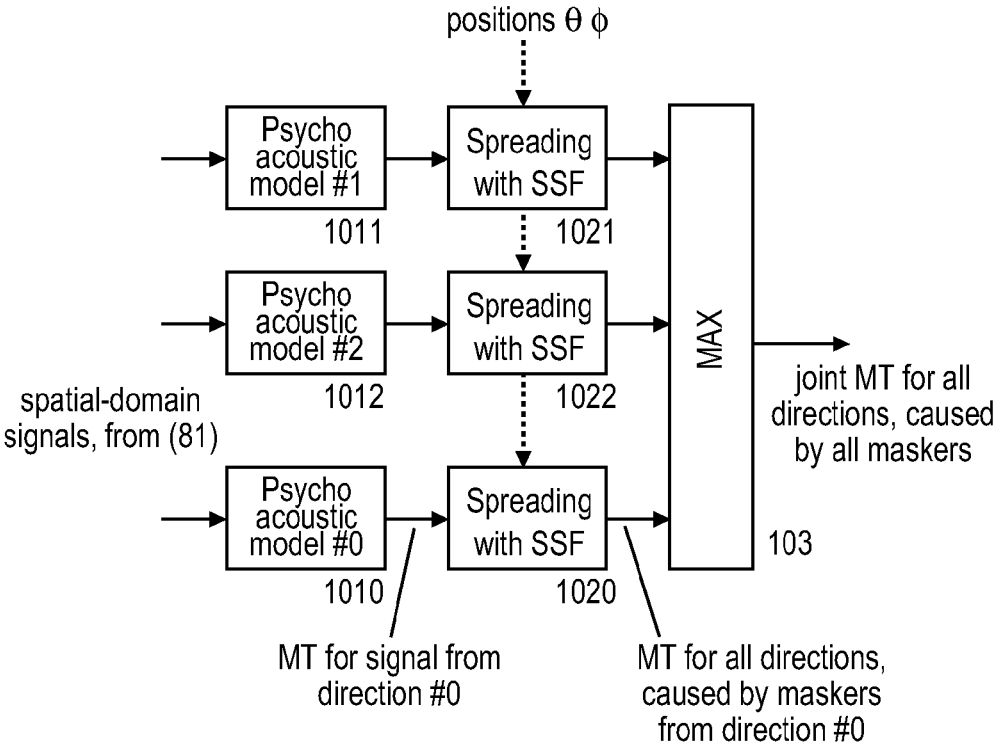
FIG. 10 joint psycho-acoustic model with incorporation of BMLD modeling.

FIG. 10 shows how a model of the BMLD can be incorporated in the psycho-acoustic modeling in order to derive a joint masking threshold MT. The individual MT for each spatial direction is calculated in psycho-acoustic model steps or stages 1011, 1012, . . . , 101O and is input to corresponding spatial spreading function SSF steps or stages 1021, 1022, . . . , 102O, which spatial spreading function is e.g. the inverse of one of the BMLDs shown in FIG. 9. Thus, an MT covering the whole sphere/circle (3D/2D case) is computed for all signal contributions from each direction. The maximum of all individual MTs is calculated in step/stage 103 and provides the joint MT for the full audio scene.

Figure 11:
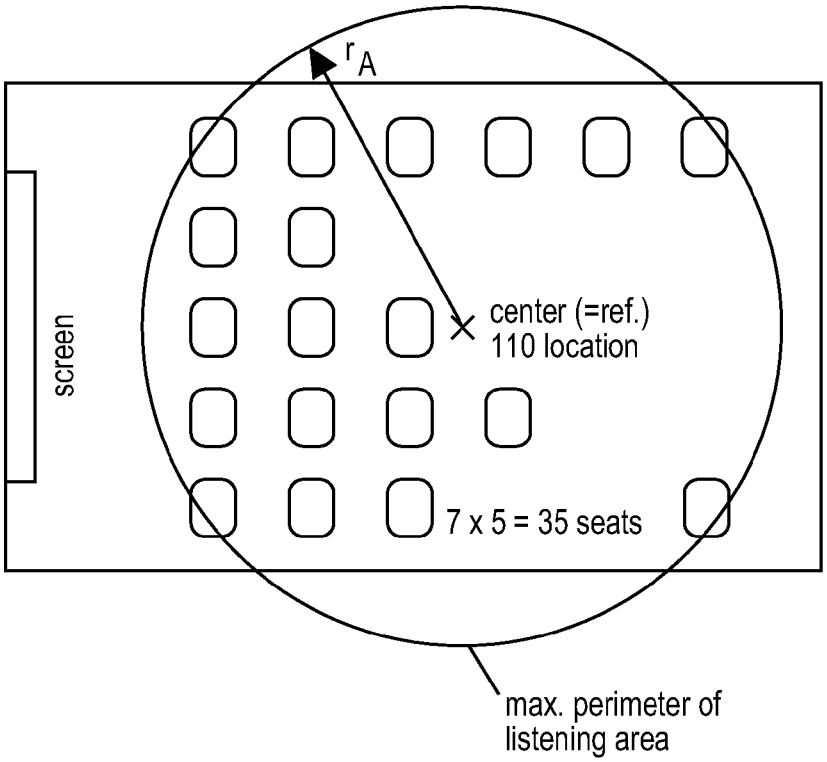
FIG. 11 example largest expected playback scenario: a cinema with 7×5 seats (arbitrarily chosen for the sake of an example)

B) A further extension of this embodiment requires a model of sound propagation in the target listening environment, e.g. in cinemas or other venues with large audiences, because sound perception depends on the listening position relative to loudspeakers. FIG. 11 shows an example cinema scenario with 7*5=35 seats. When playing back a spatial audio signal in a cinema, the audio perception and levels depend on the size of the auditorium and on the locations of the individual listeners. A 'perfect' rendering will take place at the sweet spot only, i.e. usually at the centre or reference location 110 of the auditorium. If a seat position is considered which is located e.g. at the left perimeter of the audience, it is likely that sound arriving from the right side is both attenuated and delayed relative to the sound arriving from the left side, because the direct line-of-sight to the right side loudspeakers is longer than that to the left side loudspeakers. This potential direction-dependent attenuation and delay due to sound propagation for non-optimum listening positions should be taken into account in a worst-case consideration in order to prevent unmasking of coding errors from spatially disparate directions, i.e. spatial unmasking effects. For preventing such effects, the time delay and level changes are taken into consideration in the psycho-acoustic model of the perceptual codec.

Figure 12:
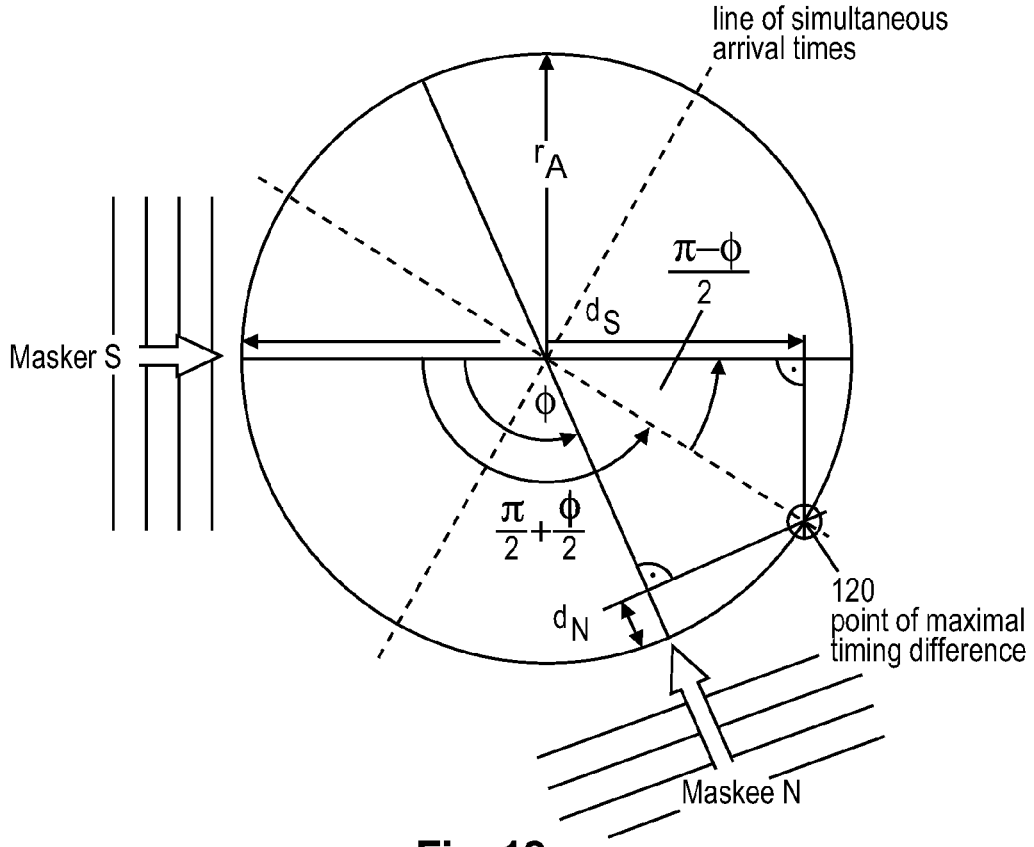
FIG. 12 derivation of maximum relative delay and attenuation for the scenario of FIG. 11.

In order to derive a mathematical expression for the modeling of the modified BMLD values, the maximum expected relative time delay and signal attenuation are modeled for any combinations of masker and maskee directions. In the following, this is performed for a 2-dimensional example setup. A possible simplification of the FIG. 11 cinema example is shown in FIG. 12. The audience is expected to reside within a circle of radius $r_A$, cf. the corresponding circle depicted in FIG. 11. Two signal directions are considered: the masker S is shown to come as a plane wave from the left (front direction in a cinema), and the maskee N is a plane wave arriving from the bottom right of FIG. 12, which corresponds to the rear left in a cinema.

The line of simultaneous arrival times of the two plane waves is depicted by the dashed bisecting line. The two points on the perimeter with the largest distance to this bisecting line are the locations within the auditorium where the largest time/level differences will occur. Before reaching the marked bottom right point 120 in the diagram the sound waves travel additional distances $d_S$ and $d_N$ after reaching the perimeter of the listening area:

$$d_S = r_A + r_A\cos\left(\frac{\pi-\phi}{2}\right),\ d_N = r_A - r_A\cos\left(\frac{\pi-\phi}{2}\right).$$

Then, the relative timing difference between masker S and maskee N at that point is $$\Delta_t = \frac{d_S - d_N}{c} = 2\frac{r_A}{c}\cos\left(\frac{\pi-\phi}{2}\right),$$

where c denotes the speed of sound.

For determining the differences in propagation loss a simple model with a loss by K=3 . . . 6 dB (the precise number depends on loudspeaker technology) per double-distance is assumed in the sequel. Furthermore it is assumed that the actual sound sources have a distance of $d_{LS}$ from the outer perimeter of the listening area. Then, the maximum propagation loss amounts to $$\Delta_L = K\log_2\left(\frac{d_{LS}+d_S}{d_{LS}+d_N}\right) = K\log_2\left(\frac{1+\frac{r_A}{r_A+d_{LS}}\cos\left(\frac{\pi-\phi}{2}\right)}{1-\frac{r_A}{r_A+d_{LS}}\cos\left(\frac{\pi-\phi}{2}\right)}\right).$$

This playback scenario model comprises the two parameters $\Delta_t(\phi)$ and $\Delta_L(\phi)$. These parameters can be integrated into the joint psycho-acoustic modeling described above by adding the respective BMLD terms, i.e. by the replacement $$SSF_{new}(\phi)=SSF_{old}(\phi)-BMLD_t(\Delta_t(\phi))-|\Delta_{L(\phi)}|.$$

Thereby, it is guaranteed that even in a large room any quantization error noise is masked by other spatial signal components.

C) The same considerations as introduced in the previous sections can be applied for spatial audio formats which combine one or more discrete sound objects with one or more HOA components. The estimation of the psycho-acoustic masking threshold is performed for the full audio scene, including optional consideration of characteristics of the target environment as explained above. Then, the individual compression of discrete sound objects as well as the compression of the HOA components take the joint psycho-acoustic masking threshold into account for bit allocation.

Figure 13:
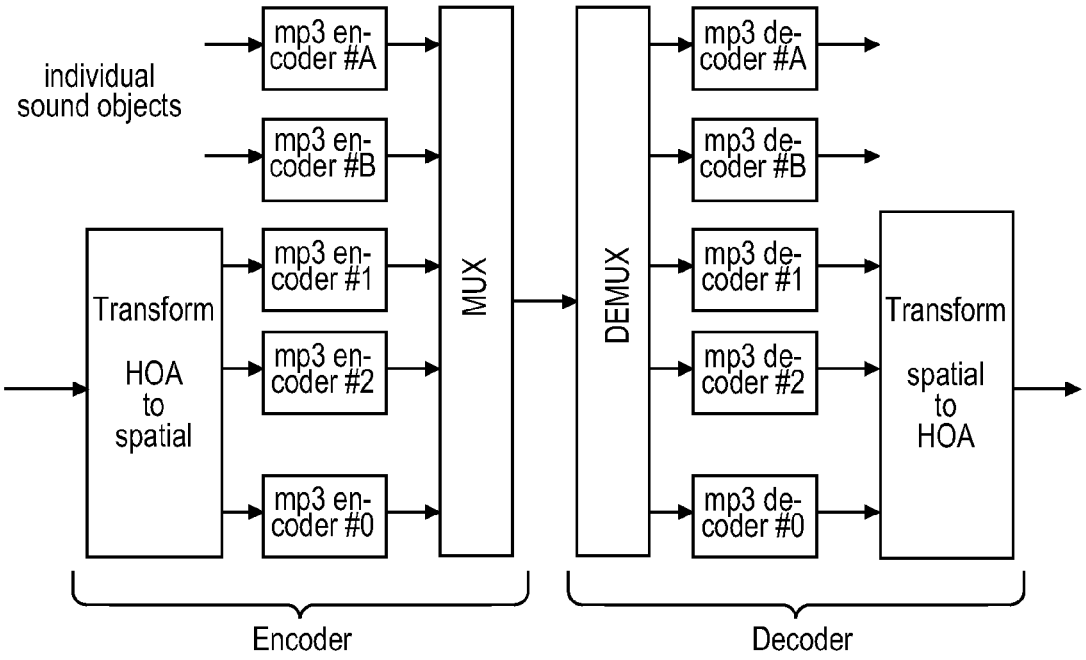
FIG. 13 compression of a sound-field HOA component plus two sound objects A and B.

Compression of more complex audio scenes comprising both a HOA part and some distinct individual sound objects can be performed similar to the above joint psycho-acoustic model. A related compression processing is depicted in FIG. 13.

Figure 14:
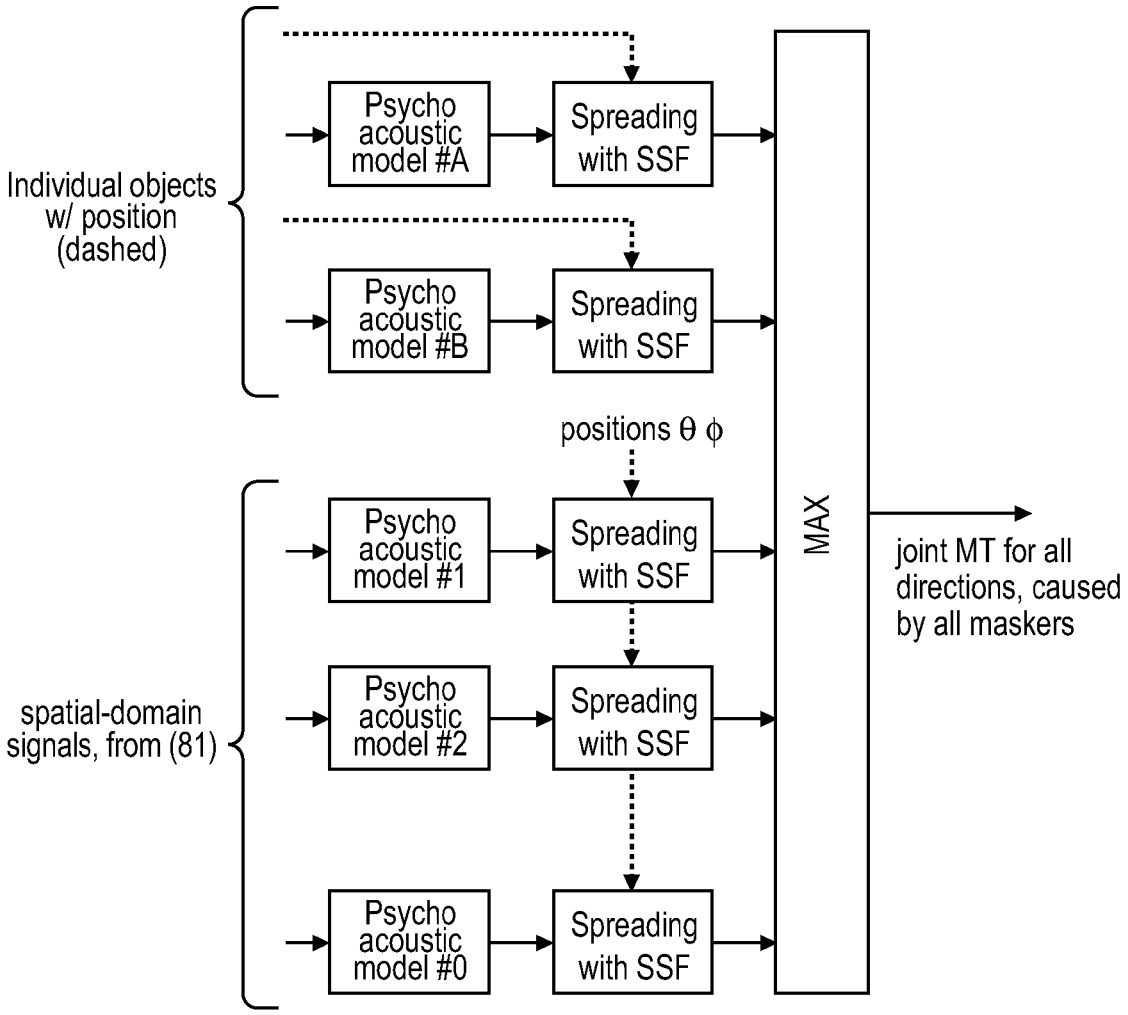
FIG. 14 joint psycho-acoustic model for a sound-field HOA component plus two sound objects A and B.

In parallel to the consideration above, a joint psycho-acoustic model should take all sound objects into account. The same rationale and structure as introduced above can be applied. A high-level block diagram of the corresponding psycho-acoustic model is shown in FIG. 14.

The invention claimed is:

1. A method for carrying out an encoding on received successive frames of a higher-order Ambisonics representation of a 2- or 3-dimensional sound field, denoted as_HOA coefficients, said method comprising:

transforming a number of $O=(N+1)^2$ input HOA coefficients of a frame into a number of O spatial domain signals representing a regular distribution of reference points on a sphere, wherein N is an order of said input HOA coefficients and is greater or equal to 3, and each one of said O spatial domain signals represents a set of plane waves which come from associated directions in space;

encoding each one of said O spatial domain signals using perceptual compression encoding steps or stages, thereby using encoding parameters selected such that a coding error is inaudible; and multiplexing the encoded spatial domain signals of the frame into a joint bit stream for providing improved lossy compression of HOA representations of audio scenes.

2. The method according to claim 1, wherein a masking used in said perceptual compression encoding is a psycho-acoustic masking and is a combination of time-frequency masking and spatial masking.

3. The method according to claim 1, wherein said transforming into O spatial domain signals is plane wave decomposition.

4. The method according to claim 1, wherein said encoding of each of said O spatial domain signals corresponds to the MPEG-1 Audio Layer III or AAC or Dolby AC-3 standard.

5. An apparatus for carrying out an encoding on received successive frames of a higher order Ambisonics representation of a 2- or 3-dimensional sound field, denoted as HOA coefficients, said apparatus comprising:

a transformer configured to transform a number $O=(N+1)^2$ input HOA coefficients of a frame into a number of O spatial domain signals representing a regular distribution of reference points on a sphere, wherein N is an order of said input HOA coefficients and is greater or equal to 3, and each one of said spatial domain signals represents a set of plane waves which come from associated directions in space;

encoders configured to encode each one of said O spatial domain signals using perceptual compression encoding steps or stages, thereby using encoding parameters selected such that a coding error is inaudible; and a hardware multiplexer configured to multiplex the encoded spatial domain signals of the frame into a joint bit stream for providing improved lossy compression of HOA representations of audio scenes.

6. The apparatus according to claim 5, wherein a masking used in said perceptual compression encoding is a psycho-acoustic masking and is a combination of time-frequency masking and spatial masking.

7. The apparatus according to claim 5, wherein said transformation is a plane wave decomposition.

8. The apparatus according to claim 5, wherein said perceptual encoding corresponds to the MPEG-1 Audio Layer III or AAC or Dolby AC-3 standard.

9. A method for decoding received successive frames of a perceptual compression encoded higher-order Ambisonics representation of a 2- or 3-dimensional sound field, which was encoded according to claim 1, said decoding comprising:

de-multiplexing a received joint bit stream into a number of $O=(N+1)^2$ perceptual compression encoded spatial domain signals;

decoding each one of said O encoded spatial domain signals into a corresponding decoded spatial domain signal using perceptual compression decoding steps or stages corresponding to a selected encoding type and using decoding parameters matching the encoding parameters, wherein said O decoded spatial domain signals represent a regular distribution of reference points on a sphere; and transforming said O decoded spatial domain signals into O output HOA coefficients of a frame, wherein N is an order of said output HOA coefficients for providing improved lossy compression of HOA representations of audio scenes.

10. The method according to claim 9, wherein said decoding of each one of said O encoded spatial domain signals corresponds to the MPEG-1 Audio Layer III or AAC or Dolby AC-3 standard.

11. An apparatus for decoding received successive frames of a perceptual compression encoded higher-order Ambisonics representation of a 2- or 3-dimensional sound field, which was encoded according to claim 1, said apparatus comprising:

a hardware demultiplexer which demultiplexes a received joint bit stream into $O=(N+1)^2$ perceptual compression encoded spatial domain signals;

decoders which decode each one of said O encoded spatial domain signals into a corresponding decoded spatial domain signal using perceptual compression decoding steps or stages corresponding to a selected encoding type and using decoding parameters matching the encoding parameters, wherein said O decoded spatial domain signals represent a regular distribution of reference points on a sphere; and a transformer transforming said O decoded spatial domain signals into O output HOA coefficients of a frame, wherein N is an order of said output HOA coefficients for providing improved lossy compression of HOA representations of audio scenes.

12. The apparatus according to claim 11, wherein said decoding of each one of said O encoded spatial domain signals corresponds to the MPEG-1 Audio Layer III or AAC or Dolby AC-3 standard.

13. An apparatus for carrying out an encoding on received successive frames of a higher order Ambisonics representation of a 2- or 3-dimensional sound field, denoted as HOA coefficients, said apparatus comprising:

a means for transforming a number $O=(N+1)^2$ input HOA coefficients of a frame into a number of O spatial domain signals representing a regular distribution of reference points on a sphere, wherein N is an order of said input HOA coefficients and is greater or equal to 3, and each one of said spatial domain signals represents a set of plane waves which come from associated directions in space;

a means for encoding each one of said O spatial domain signals using perceptual compression encoding steps or stages, thereby using encoding parameters selected such that a coding error is inaudible; and a means for multiplexing the encoded spatial domain signals of the frame into a joint bit stream for providing improved lossy compression of HOA representations of audio scenes.

14. The apparatus according to claim 13, wherein a means for masking used in said perceptual compression encoding is a psycho-acoustic masking and is a combination of time-frequency masking and spatial masking.

15. The apparatus according to claim 13, wherein said means for transforming is a plane wave decomposition.

16. The apparatus according to claim 13, wherein a means for said perceptual compression encoding corresponds to the MPEG-1 Audio Layer III or AAC or Dolby AC-3 standard.

17. An apparatus for decoding received successive frames of a perceptual compression encoded higher-order Ambisonics representation of a 2- or 3-dimensional sound field, which was encoded according to claim 1, said apparatus comprising:

a means for demultiplexing a received joint bit stream into $O=(N+1)^2$ perceptual compression encoded spatial domain signals;

a means for decoding each one of said O encoded spatial domain signals into a corresponding decoded spatial domain signal using perceptual compression decoding steps or stages corresponding to a selected encoding type and using decoding parameters matching the encoding parameters, wherein said O decoded spatial domain signals represent a regular distribution of reference points on a sphere; and a means for transforming said O decoded spatial domain signals into O output HOA coefficients of a frame, wherein N is an order of said output HOA coefficients for providing improved lossy compression of HOA representations of audio scenes.

18. The apparatus according to claim 17, wherein said means for decoding of each one of said O encoded spatial domain signals corresponds to the MPEG-1 Audio Layer III or AAC or Dolby AC-3 standard.

* * * * *